US009617901B2

(12) United States Patent
Sasaki et al.

(10) Patent No.: US 9,617,901 B2
(45) Date of Patent: Apr. 11, 2017

(54) EXHAUST CONTROL DEVICE FOR ENGINE

(71) Applicant: SUZUKI MOTOR CORPORATION, Hamamatsu-shi, Shizuoka (JP)

(72) Inventors: Eiji Sasaki, Hamamatsu (JP); Tomoaki Onagi, Hamamatsu (JP); Yoshisato Inayama, Hamamatsu (JP); Takanori Chino, Hamamatsu (JP); Toshihiro Hayashi, Hamamatsu (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 146 days.

(21) Appl. No.: 13/767,153

(22) Filed: Feb. 14, 2013

(65) Prior Publication Data

US 2013/0205760 A1 Aug. 15, 2013

(30) Foreign Application Priority Data

Feb. 14, 2012 (JP) ..... 2012-029898

(51) Int. Cl.

| | |
|---|---|
| ***F01N 1/00*** | (2006.01) |
| ***F01N 13/08*** | (2010.01) |
| ***F02D 9/04*** | (2006.01) |
| ***F01N 13/10*** | (2010.01) |

(52) U.S. Cl.

CPC ..... *F01N 13/08* (2013.01); *F01N 13/107* (2013.01); *F02D 9/04* (2013.01); *F01N 2240/36* (2013.01); *F01N 2260/14* (2013.01); *F01N 2590/04* (2013.01)

(58) Field of Classification Search

CPC ..... F01N 13/08; F01N 13/107; F02B 27/06; F02D 9/04

USPC ..... 60/324; 181/254, 268

See application file for complete search history.

(56) References Cited

U.S. PATENT DOCUMENTS

| | | | | |
|---|---|---|---|---|
| 3,559,397 | A | 2/1971 | Navarro | |
| 4,840,029 | A | 6/1989 | Sakurai et al. | |
| 4,869,063 | A | 9/1989 | Sakurai et al. | |
| 4,999,999 | A * | 3/1991 | Takahashi et al. | 60/313 |
| 6,609,367 | B2 | 8/2003 | Nakayasu et al. | |
| 6,655,134 | B2 | 12/2003 | Nakayasu et al. | |
| 7,111,701 | B2 | 9/2006 | Nagashii et al. | |
| 7,703,574 | B2 * | 4/2010 | Kruger et al. | 181/254 |

(Continued)

FOREIGN PATENT DOCUMENTS

| | | |
|---|---|---|
| JP | H02-37110 A | 2/1990 |
| JP | 2004-301026 A | 10/2004 |

(Continued)

OTHER PUBLICATIONS

Machine English translation of JP H02-37110.*

European Search Report, dated Jun. 11, 2013, which issued during the prosecution of European Patent Application No. 13154782.0.

*Primary Examiner* — Audrey K Bradley
*Assistant Examiner* — Jason Sheppard
(74) *Attorney, Agent, or Firm* — Troutman Sanders LLP

(57) ABSTRACT

An exhaust control device for an engine performs exhaust control of an exhaust system composed of exhaust pipes connected to a plurality of cylinders respectively and gathering to a collecting pipe. The exhaust control device includes at least two kinds of exhaust valves that perform the exhaust control at different parts in the exhaust system; and a single actuator that drives the exhaust valves to open and close.

3 Claims, 14 Drawing Sheets

(56) References Cited

U.S. PATENT DOCUMENTS

| | | | | |
|---|---|---|---|---|
| 2001/0027648 | A1 | 10/2001 | Nakayasu et al. | |
| 2001/0035009 | A1 | 11/2001 | Nakayasu et al. | |
| 2002/0050415 | A1* | 5/2002 | Kawamoto | F01N 13/08 180/219 |
| 2004/0206564 | A1 | 10/2004 | Nagashii et al. | |
| 2008/0236151 | A1* | 10/2008 | Morita et al. | 60/324 |

FOREIGN PATENT DOCUMENTS

| | | | |
|---|---|---|---|
| JP | 2007-247546 | A | 9/2007 |
| JP | 4015353 | B2 | 11/2007 |
| WO | 2007/089771 | A2 | 8/2007 |

* cited by examiner

EXHAUST CONTROL DEVICE FOR ENGINE

CROSS-REFERENCE TO RELATED APPLICATIONS

This application is based upon and claims the benefit of priority of the prior Japanese Patent Application No. 2012-029898, filed on Feb. 14, 2012, the entire contents of which are incorporated herein by reference.

BACKGROUND OF THE INVENTION

Field of the Invention

The present invention relates to an exhaust control device for an engine of a vehicle, for example, a motorcycle or the like, that performs exhaust control in an exhaust pipe to improve output.

Description of the Related Art

In a vehicle of this kind, an exhaust control device is disposed which is configured such that an exhaust valve is provided along an exhaust pipe to open and close an exhaust path to improve the exhaust efficiency. The one in which an exhaust control valve is provided along an exhaust pipe to improve the exhaust performance is disclosed, for example, in Patent Document 1.

It is also possible to provide, along the exhaust pipe in the motorcycle or the like, two exhaust valves that operate in different rotation ranges of the engine. Conventionally, when two exhaust valves are provided as described above, the exhaust valves are usually driven by electronically controlled actuators respectively. Thus, it becomes possible to perform more appropriate exhaust control of the two exhaust valves according to the engine rotation number.

Patent Document 1: Japanese Patent No. 4015353

Conventionally, in the case where two exhaust valves are provided, for example, as in the above example, an independent actuator is provided for control of driving each of the exhaust valves. Provision of a plurality of actuators as described above not only complicates the device structure but also greatly increases the cost.

SUMMARY OF THE INVENTION

An object of the present invention is to provide an exhaust control device for an engine that realizes an excellent control performance for an exhaust system while simplifying the structure in consideration of the above circumstances.

An exhaust control device for an engine of the present invention is an exhaust control device for an engine that performs exhaust control of an exhaust system composed of exhaust pipes connected to a plurality of cylinders respectively and gathering to a collecting pipe, including: at least two kinds of exhaust valves that perform the exhaust control at different parts in the exhaust system; and a single actuator that drives the exhaust valves to open and close.

The exhaust control device for an engine of the present invention further includes: a communication pipe that communicates the exhaust pipes with each other, wherein a first exhaust valve among the exhaust valves is attached to the communication pipe and controls opening/closing of the communication pipe.

Further, in the exhaust control device for an engine of the present invention, a second exhaust valve among the exhaust valves is attached to the collecting pipe and controls opening/closing of the collecting pipe.

The exhaust control device for an engine of the present invention further includes: a plurality of the communication pipes that communicate specified ones of the exhaust pipes, wherein the first exhaust valves attached to the communication pipes respectively are coaxially arranged.

Further, in the exhaust control device for an engine of the present invention, the first exhaust valve is driven to open and close in one rotational operation range of the actuator, and the second exhaust valve is driven to open and close in another rotational operation range of the actuator.

Further, in the exhaust control device for an engine of the present invention, the first exhaust valve and the second exhaust valve are set such that the first exhaust valve is closed and the second exhaust valve is opened to a half opening degree in an engine low rotation range.

Further, in the exhaust control device for an engine of the present invention, the first exhaust valve and the second exhaust valve are set such that the second exhaust valve is operated and the first exhaust valve is fully opened in an engine high rotation range.

DETAILED DESCRIPTION OF THE PREFERRED EMBODIMENTS

Hereinafter, a preferred embodiment of an exhaust control device for an engine according to the present invention will be described based on the drawings.

Figure 1:
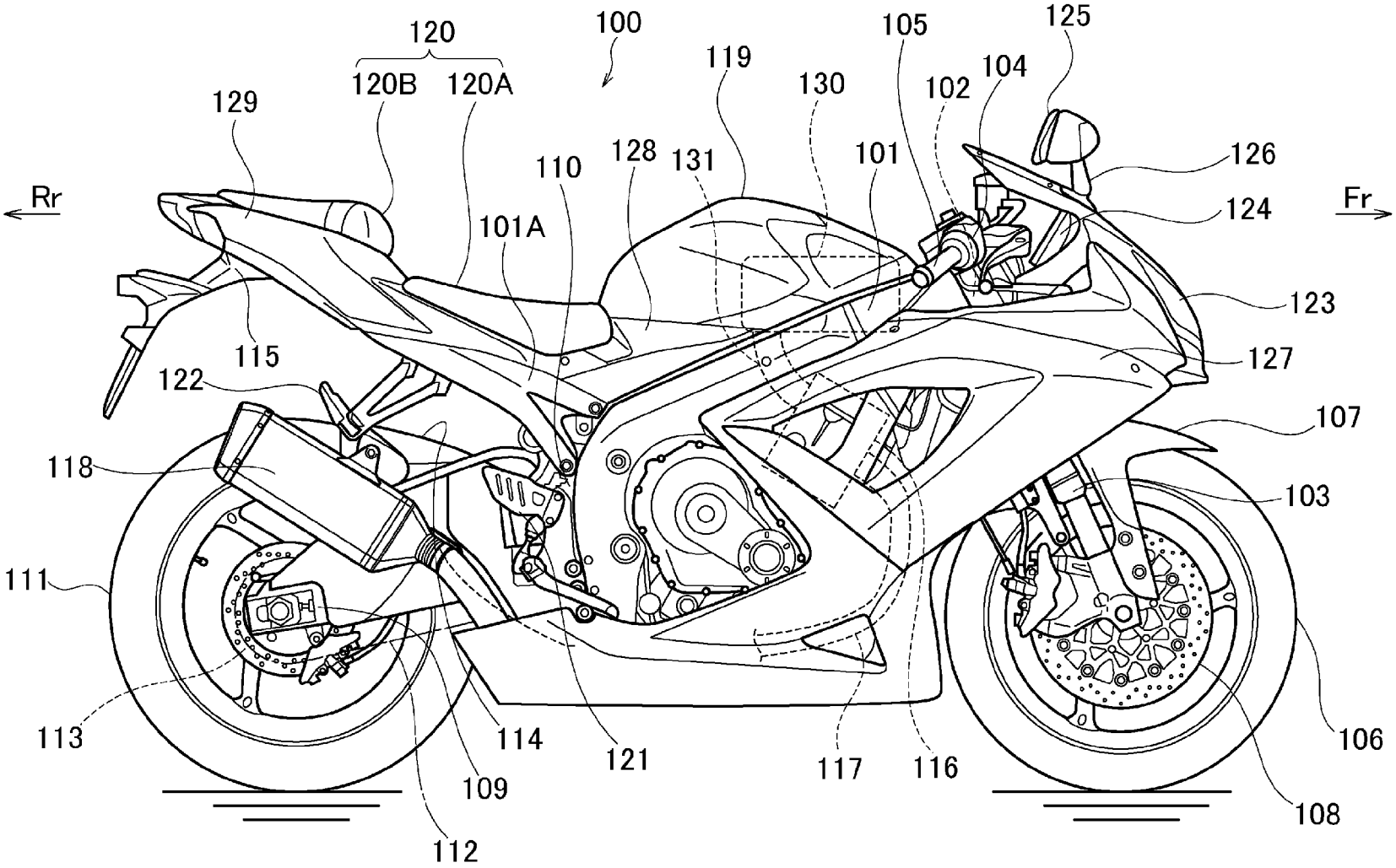
FIG. 1 is a side view illustrating the entire structure of a motorcycle according to the present invention.

FIG. 1 is a side view of a motorcycle 100 according to the present invention. First, an entire structure of the motorcycle 100 will be described using FIG. 1. Note that in the drawings including FIG. 1 used in the following explanation, as necessary, the front of a vehicle is indicated by an arrow Fr and the rear of the vehicle is indicated by an arrow Rr, respectively, and a lateral right side of the vehicle is indicated by an arrow R, and a lateral left side of the vehicle is indicated by an arrow L, respectively.

In FIG. 1, at a front portion of a main frame 101 made of steel or an aluminum alloy material, a pair of right and left front forks 103 are provided that are supported to be turnable right and left by means of a steering head pipe 102. A handle bar 104 is fixed to upper ends of the front forks 103, and grips 105 are provided at both ends of the handle bar 104. A front wheel 106 is rotatably supported on lower portions of the front forks 103, and a front fender 107 is fixed to the lower portions of the front forks 103 so as to cover an upper portion of the front wheel 106. To the front wheel 106, a brake disk 108 is additionally provided that rotates integrally with the front wheel 106.

The main frame 101 is connected to a rear portion of the steering head pipe 102 and further branched into a pair of right and left parts in a two-pronged shape toward the rear, and each of the parts extends at a slant rearward and downward. Seat rails 101A extend at a moderate slant rearward and upward from the vicinity of the rear portions of the main frame 101 and support a later-described seat. Note that the main frame 101 and the seat rails 101A constitute a vehicle frame. Further, swing arms 109 are coupled to rear portions of the main frame 101 in a swingable manner, and a rear shock absorber 110 is laid between the swing arms 109. A rear wheel 111 is rotatably supported on rear ends of the swing arms 109. The rear wheel 111 is configured to be rotationally driven via a driven sprocket 113 around which a chain 112 to transmit motive power of the later-described engine is wound. An inner fender 114 covering the vicinity of a front upper portion of the rear wheel 111 is provided closely around the rear wheel 111, and a rear fender 115 is disposed above the inner fender 114.

An engine unit 116 (a broken line part in FIG. 1) mounted on the main frame 101 is supplied with an air-fuel mixture made by mixing fuel from a not-illustrated fuel supply system and air from an air cleaner. An exhaust gas after combustion in the engine is exhausted through an exhaust pipe 117. In this embodiment, the engine may also be, for example, a four-cycle multicylinder, typically, a four-cylinder engine. The exhaust pipes 117 of the respective cylinders are coupled to one another on the lower side of the engine unit 116, and the exhaust gas is then exhausted from a muffler 118 supported in the vicinity of the rear portion on the right side of the vehicle.

Further, a fuel tank 119 is mounted above the engine unit 116, and a seat 120 is provided continuously to the rear of the fuel tank 119. The seat 120 includes a rider seat 120A and a tandem seat 120B. Foot rests 121 and foot rests or pillion steps 122 are disposed corresponding to the rider seat 120A and the tandem seat 120B. Note that in this example, on the left side of the vehicle, a not-illustrated prop stand is provided at a substantially middle lower portion in the front and rear direction.

Further, in FIG. 1, a numeral 123 denotes a head lamp, a numeral 124 denotes a meter unit including a speedometer, a tachometer, various indicator lamps, and so on, and a numeral 125 denotes a rearview mirror supported on the handle bar 104 via a stay 126.

As for the exterior of the vehicle, mainly a front portion and side portions of the vehicle are covered with a fairing 127 and side cowls 128, a rear portion of the vehicle is covered with a side cover or a seat cowl 129, so that the exterior members form an exterior form of the vehicle having a so-called streamlined shape.

Note that the fuel tank 119 in a dome shape or in a carapace shape as illustrated in FIG. 1 is mounted and supported on the main frame 101 in a manner to cover the whole upper side of the main frame 101 from above. Further, an air cleaner 130 for supplying clean air to an intake system is disposed on the upper side of the engine unit 116. The air cleaned by the air cleaner 130 is taken in by the intake system and then mixed with fuel inside an intake pipe 131 as illustrated in FIG. 1 and then supplied as the air-fuel mixture to the engine unit 116.

Figure 2:
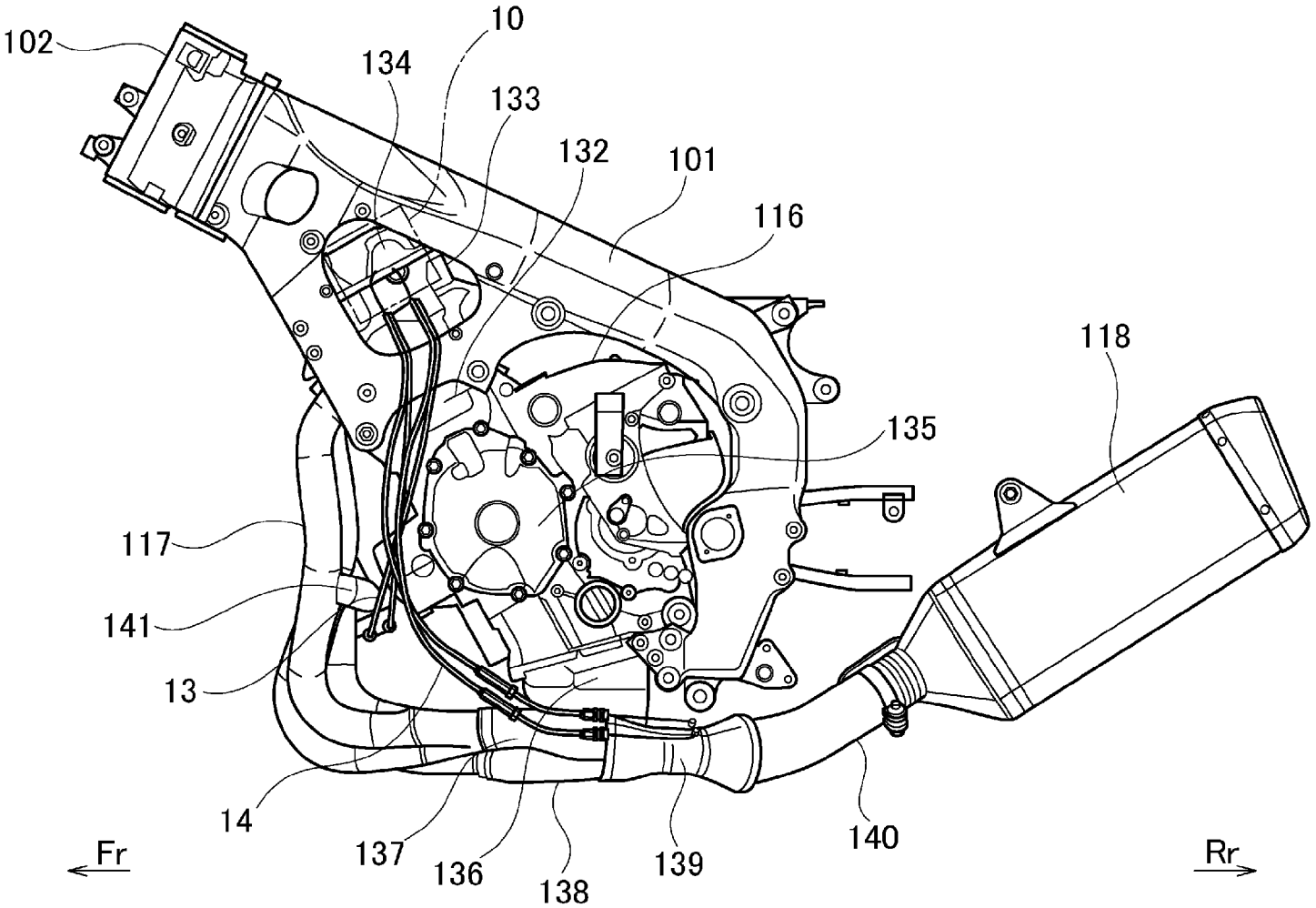
FIG. 2 is a side view illustrating a concrete structure example of the periphery of an engine unit in an embodiment of the present invention.
Figure 3:
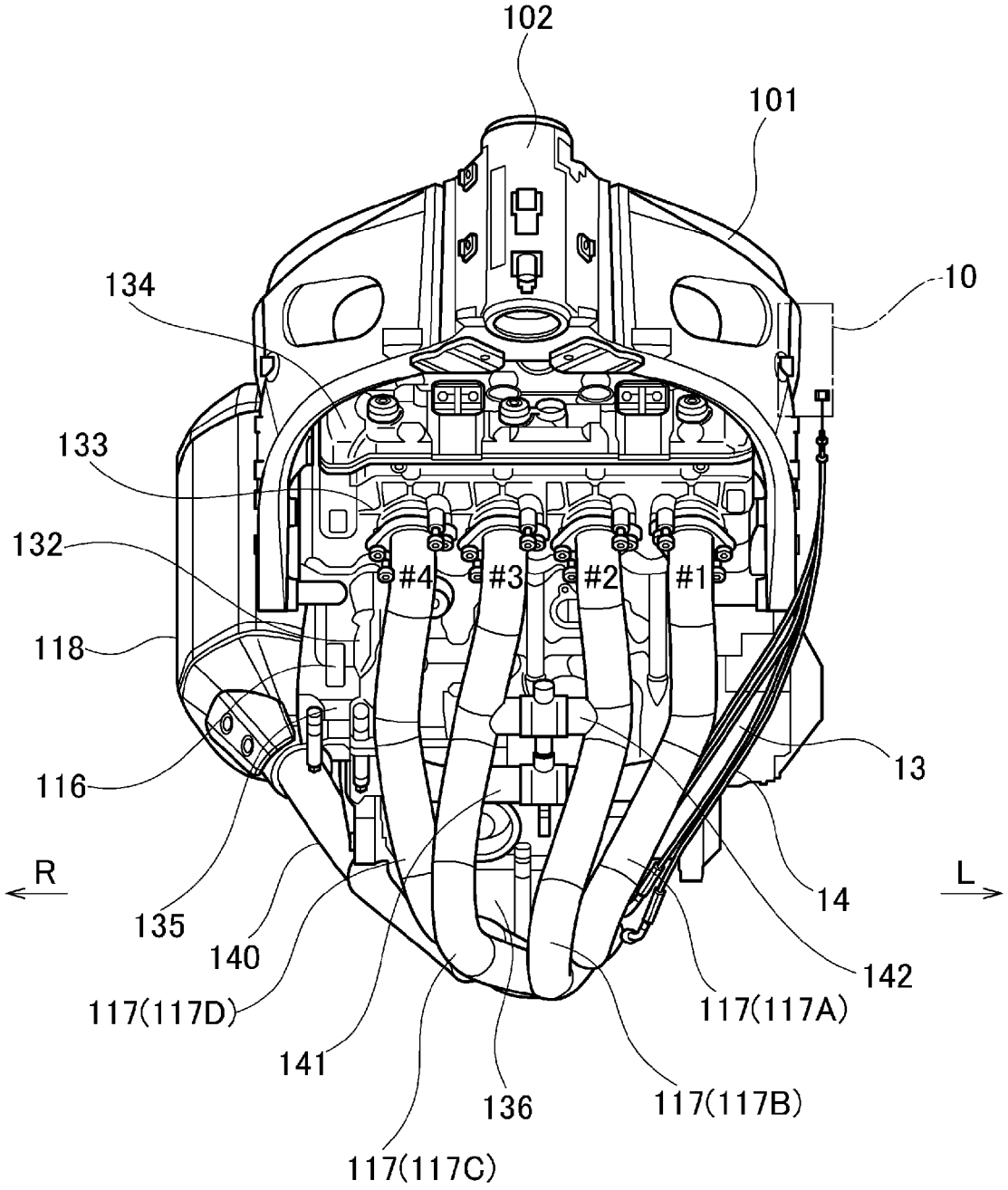
FIG. 3 is a front view illustrating the concrete structure example of the periphery of the engine unit in the embodiment of the present invention.

Next, FIG. 2 and FIG. 3 illustrate a concrete structure example of the periphery of the engine unit 116 in this embodiment. In this example, in the engine unit 116 with parallel four cylinders, a cylinder head 133 and a cylinder head cover 134 are sequentially coupled to the upper side of a cylinder block 132 that is disposed to incline forward, whereas a crankcase 135 is integrally coupled to the lower side of the cylinder block 132. Further, an oil pan 13 is additionally provided at a bottom portion of the crankcase 135. Note that the cylinder arrangement of the engine unit 116 is configured such that a #1 cylinder, a #2 cylinder, a #3 cylinder, and a #4 cylinder are arranged from left to right. The engine unit 116 is suspended from the main frame 101 via a plurality of engine mounts and thereby integrally coupled to the main frame 101 and functions as a rigid member of the main frame 101 in itself.

Here, the exhaust pipe 117 of the #1 cylinder and the exhaust pipe 117 of the #2 cylinder join together at a joint part 137, and the exhaust pipe 117 of the #3 cylinder and the exhaust pipe 117 of the #4 cylinder join together at a joint part 138. The joint part 137 and the joint part 138 further join to each other, whereby the four exhaust pipes 117 of the #1 to #4 cylinders collect at a single collecting pipe 139 at a substantially lower left of the oil pan 136. The collecting pipe 139 is connected to the muffler 118 via a connection pipe 140. As will be described later, an exhaust valve relating to the exhaust control device of the present invention is attached to the collecting pipe 139.

Further, the exhaust pipes 117 (117A, 117D) on both right and left ends of the #1 and #4 cylinders communicate with each other via a communication pipe 141. The communication pipe 141 is horizontally laid on the back side of the exhaust pipes 117 on both right and left ends. The exhaust pipes 117 (117B, 117C) of the #2 and #3 cylinders communicate with each other via a communication pipe 142. The communication pipe 142 is laid to be sandwiched between the exhaust pipes 117 of the #2 and #3 cylinders and is disposed to be located diagonally above and in front of the communication pipe 141. As will be described later, the exhaust valves relating to the exhaust control device of the present invention are attached to the communication pipe 141 and the communication pipe 142.

An exhaust system from the exhaust pipes 117 (117A to 117D) to the muffler 118 via the joint part 137 and the joint part 138 and then via the collecting pipe 139 and the connection pipe 140 is configured as described above. To perform exhaust control of the exhaust system, the exhaust control device 10 is provided. The exhaust control device 10 has at least two kinds of exhaust valves performing exhaust control at different parts in the exhaust system, and a single actuator drives the exhaust valves to open and close.

Figure 4:
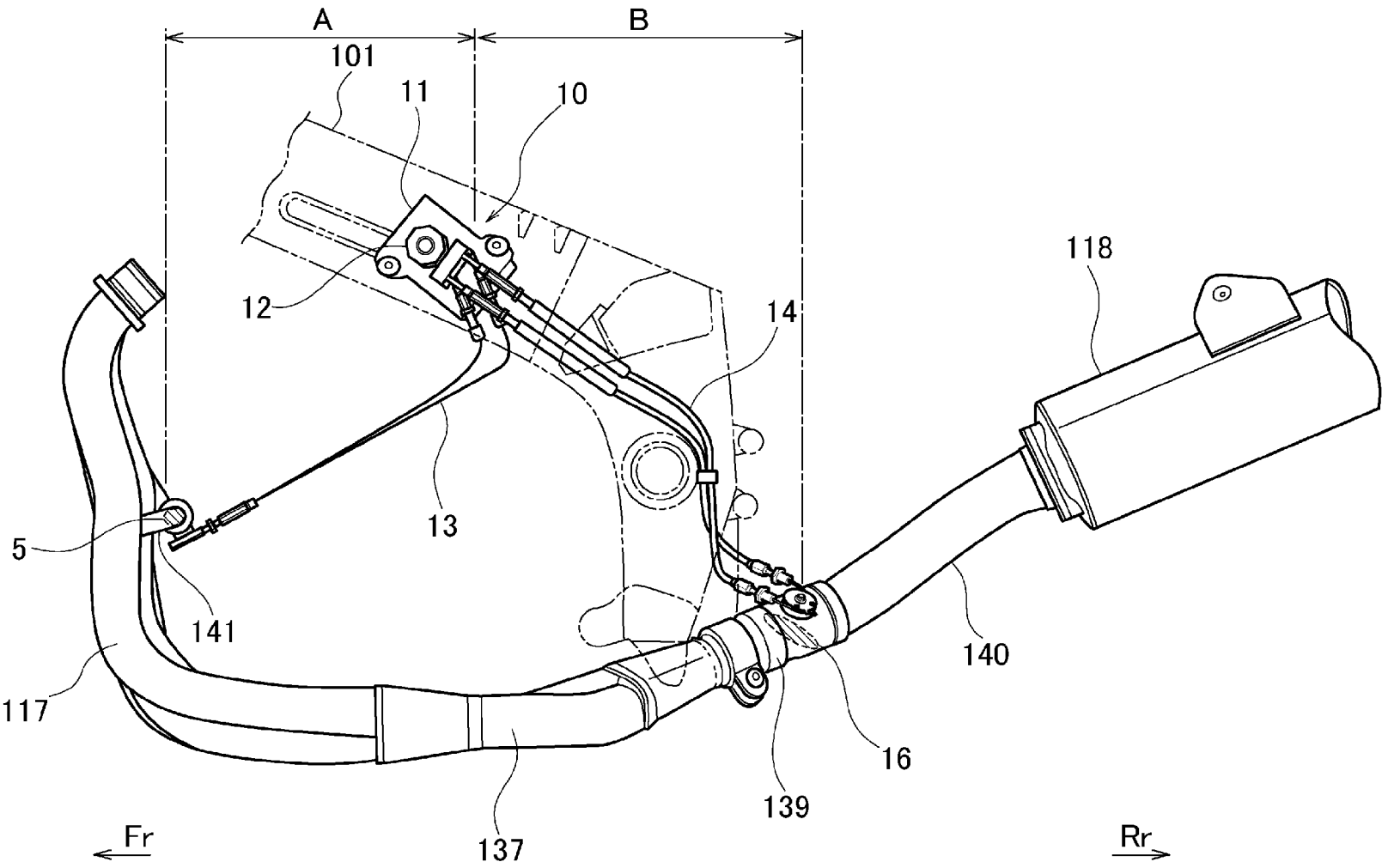
FIG. 4 is a side view illustrating a concrete structure example of an exhaust control device in the embodiment of the present invention.

FIG. 4 illustrates a concrete structure example of the exhaust control device 10. In this embodiment, parts to which the present invention is applied are the exhaust pipes 117 and the collecting pipe 139, and an actuator unit 11 performing the exhaust control on the parts is provided. In this example, the actuator unit 11 uses the main frame 101, more specifically, the main frame 101 on the left side also illustrated in FIG. 3 and is mounted and supported on the main frame 101 on the left side. The actuator unit 11 has a drive part 12 and drives the exhaust valves which are controlled objects that are connected to the drive part 12 via wires 13, 14 respectively. As the controlled objects, exhaust valves 15 (first exhaust valves) attached to the communication pipe 141 and the communication pipe 142 and an exhaust valve 16 (second exhaust valve) attached to the collecting pipe 139 are arranged. Though detailed illustration of the exhaust valves 15 and the exhaust valve 16 themselves are omitted in FIG. 4, rotational driving of the exhaust valves 15 enables control of opening/closing of the communication pipe 141 and the communication pipe 142. Note that the communication pipe 141 is schematically illustrated in FIG. 4. Further, rotational driving of the exhaust valve 16 enables control of opening/closing of the collecting pipe 139.

Figure 5:
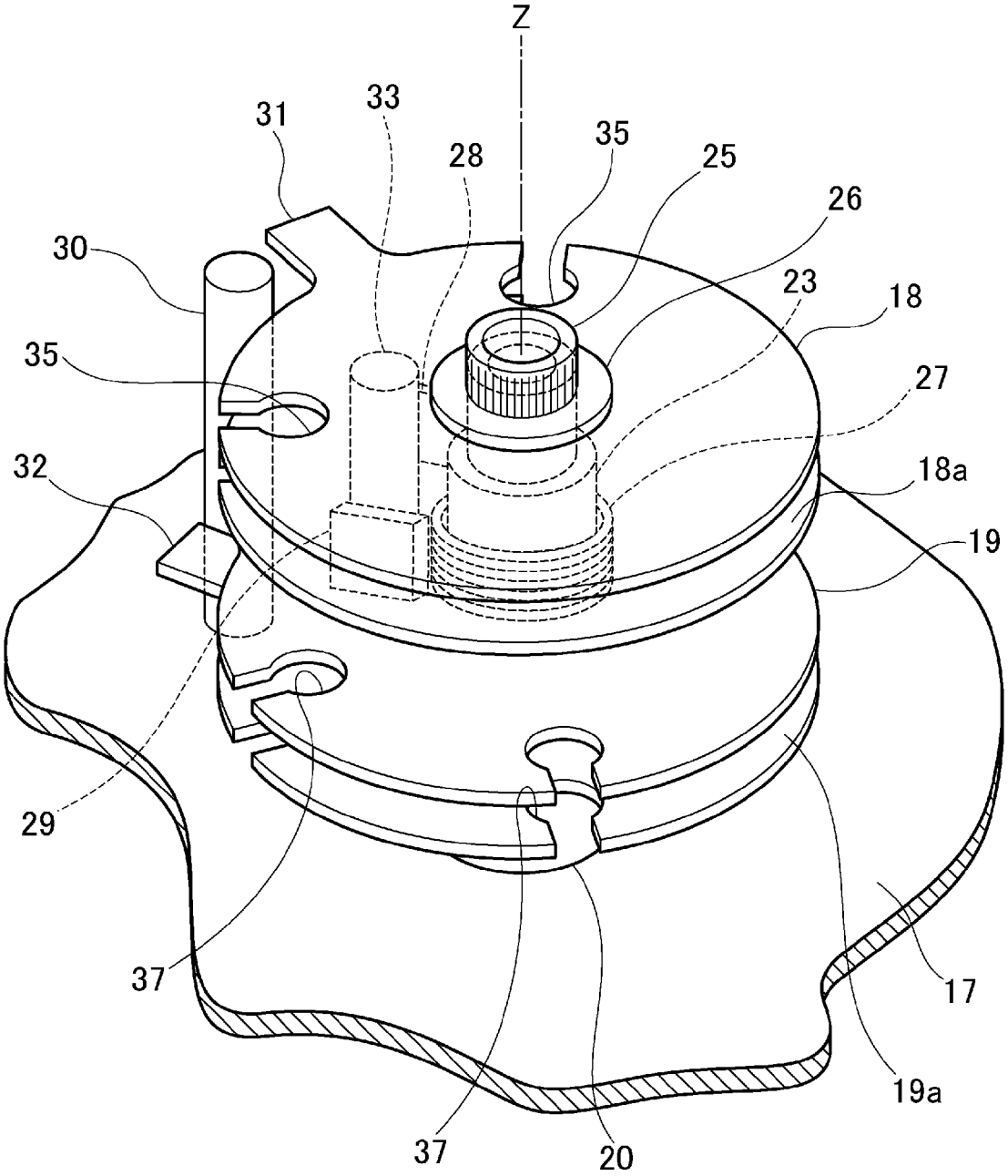
FIG. 5 is a perspective view of an essential part of an actuator unit in the embodiment of the present invention.
Figure 6:
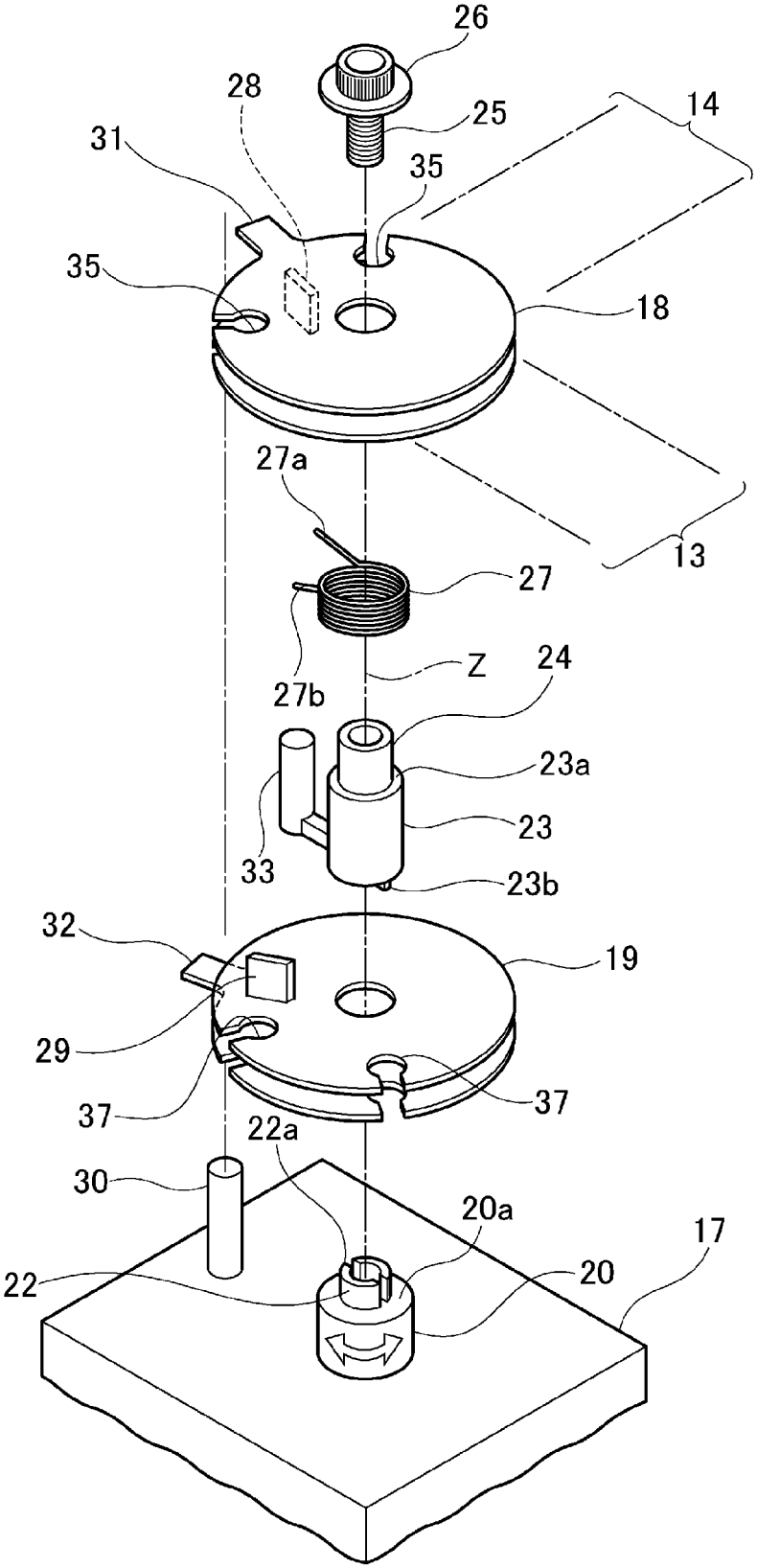
FIG. 6 is an exploded perspective view of the actuator unit in the embodiment of the present invention.
Figure 7:
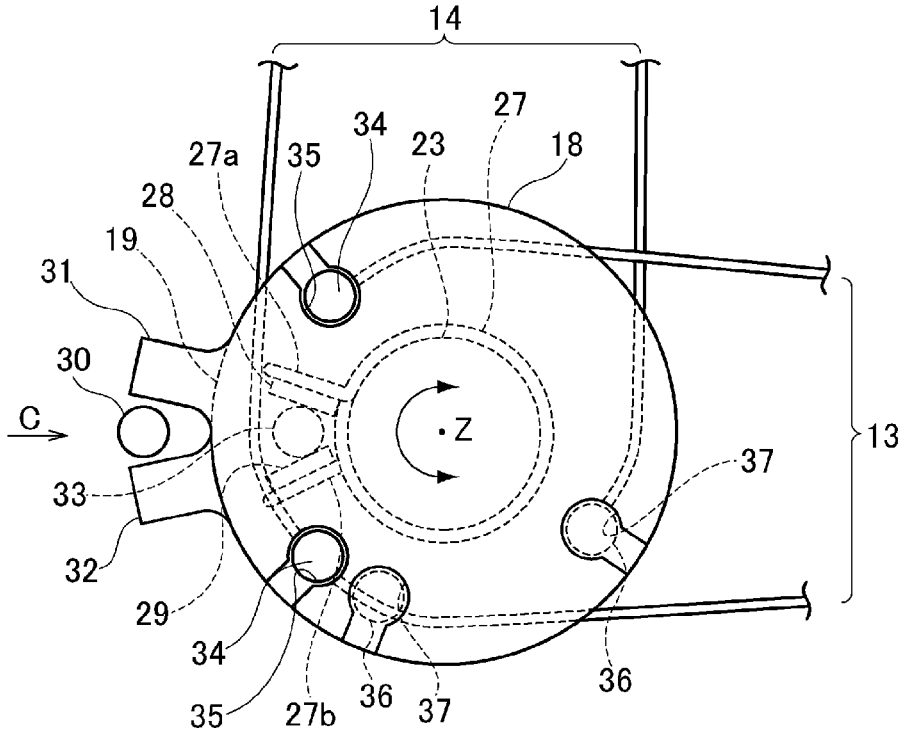
FIG. 7 is a plan view of the actuator unit in the embodiment of the present invention.
Figure 8:
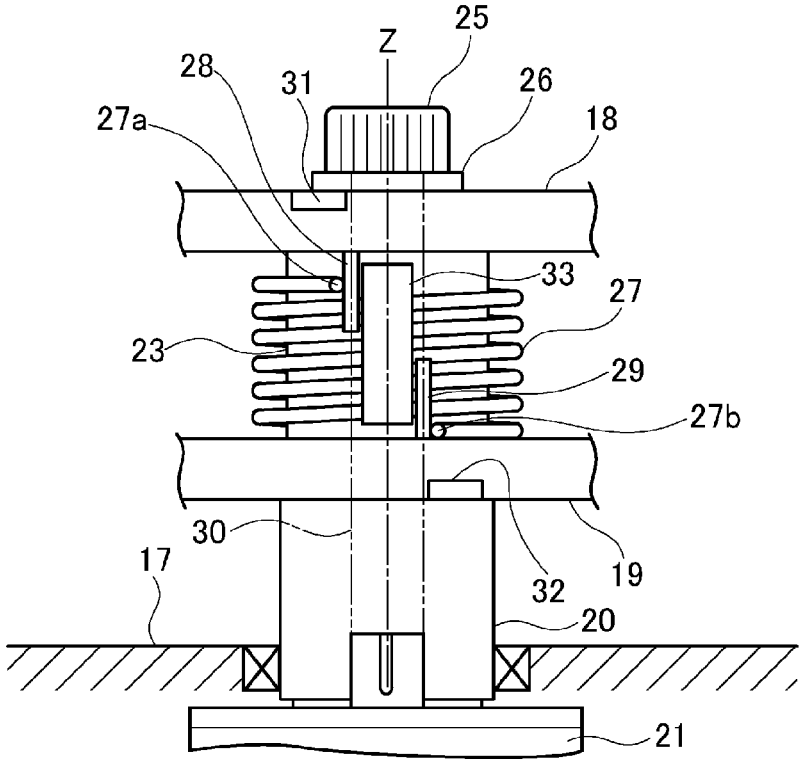
FIG. 8 is a front view in an arrow C direction in FIG. 7.

Further, the actuator unit 11 will be concretely described. FIG. 5 is a perspective view of an essential part of the actuator unit 11, FIG. 6 is an exploded perspective view of the essential part, FIG. 7 is a plan view of the essential part, and FIG. 8 is a front view in an arrow C direction in FIG. 7. The actuator unit 11 has, on a base 17, a first pulley 18 and a second pulley 19 supported to be rotatable around a rotation axis Z as will be described later, so that the wires 13, 14 are wound by the first pulley 18 and the second pulley 19. The first pulley 18 and the second pulley 19 have guide grooves 18*a*, 19*a* formed on outer peripheral parts thereof for winding the wires 13, 14 thereon. The base 17 has an actuator 20 that reciprocally rotates like a double-headed arrow in FIG. 6. The actuator 20 is rotationally driven by, for example, a stepping motor 21 that is a drive source as illustrated in FIG. 8 in predetermined timing, direction and amount (angle). At a stepped part 20*a* of the actuator 20, a guide shaft 22 is projectingly provided so that the second pulley 19 is rotatable around the guide shaft 22 on the stepped part 20*a*.

A spacer 23 is coaxially and integrally coupled with the actuator 20. In this case, an engaging projection 23*b* of the spacer 23 engages with an engaging groove 22*a* of the guide shaft 22 so that the spacer 23 is rotationally driven by the actuator 20. At a stepped part 23*a* of the spacer 23, a guide shaft is projectingly provided so that the first pulley 18 is rotatable around the guide shaft 24 on the stepped part 23*a*. A bolt 25 with a washer 26 is screwed into the guide shaft 24, whereby the first pulley 18 and the second pulley 19 are coaxially held. The two first pulley 18 and second pulley 19 are mounted on the single actuator 20 as described above and thereby enable control the two exhaust valves 15 and the exhaust valve 16.

A torsion spring 27 is attached to the outer periphery of the spacer 23 so that the resilient force of the torsion spring 27 urges the first pulley 18 and the second pulley 19 in predetermined directions as will be described later. On a surface of the first pulley 18 on the side facing the torsion spring 27, a projection 28 is projected, and one end 27*a* of the torsion spring 27 comes into press contact with the projection 28. Further, on a surface of the second pulley 19 on the side facing the torsion spring 27, a projection 29 is projected, and another end 27*b* of the torsion spring 27 comes into press contact with the projection 29. The torsion spring is attached so that the one end 27*a* and the other end 27*b* have habits in directions of winding each other and hold the two projections 28, 29 therebetween from outside to urge them to approach each other.

On the other hand, a stopper 30 in a bar shape located outside the outer peripheral portions of the first pulley 18 and the second pulley 19 is standingly provided on the base 17. Further, at the outer peripheral portions of the first pulley 18 and the second pulley 19, small projection pieces 31, 32 are additionally provided to project in a radial direction. The small projection pieces 31, 32 come into contact with the stopper 30 as illustrated in FIG. 7, whereby the first pulley 18 and the second pulley 19 urged as described above by the resilient force of the torsion spring 27 via the projections 28, are positioned and fixed in the rotation direction, which is regarded as a home position HP. Further, the torsion spring 27 restricts the relative rotation between the first pulley 18 and the second pulley 19 so as to synchronize the first pulley 18 and the second pulley 19, at all times of rotation thereof, with the actuator 20.

At the home position HP, the first pulley 18 and the second pulley 19 are restricted in position by the stopper 30 as described above, whereby the projection 28 and the projection 29 do not approach any further but are held at a predetermined interval. At the spacer 23, an arm 33 for transmitting the rotation force of the actuator 20 to the first pulley 18 and the second pulley 19 extends to positions corresponding to the projections 28, 29. The arm 33 is formed in a rod shape having a length corresponding to the interval between the projection 28 and the projection 29 in Z-direction of the rotation shaft, and can come into contact with both the projections 28, 29.

Each of the wire 13 and the wire 14 wound around the first pulley 18 and the second pulley 19 respectively is constituted of two wires making a set. In this case, terminals 34 of the wires 13 are held in lock holes 35 of the first pulley 18, and terminals 36 of the wires 14 are held in lock holes 37 in the second pulley 19. The wires 13 and the wires 14 are configured such that when one of the wires making the set is wound, the other wire is reeled out.

Figure 10:
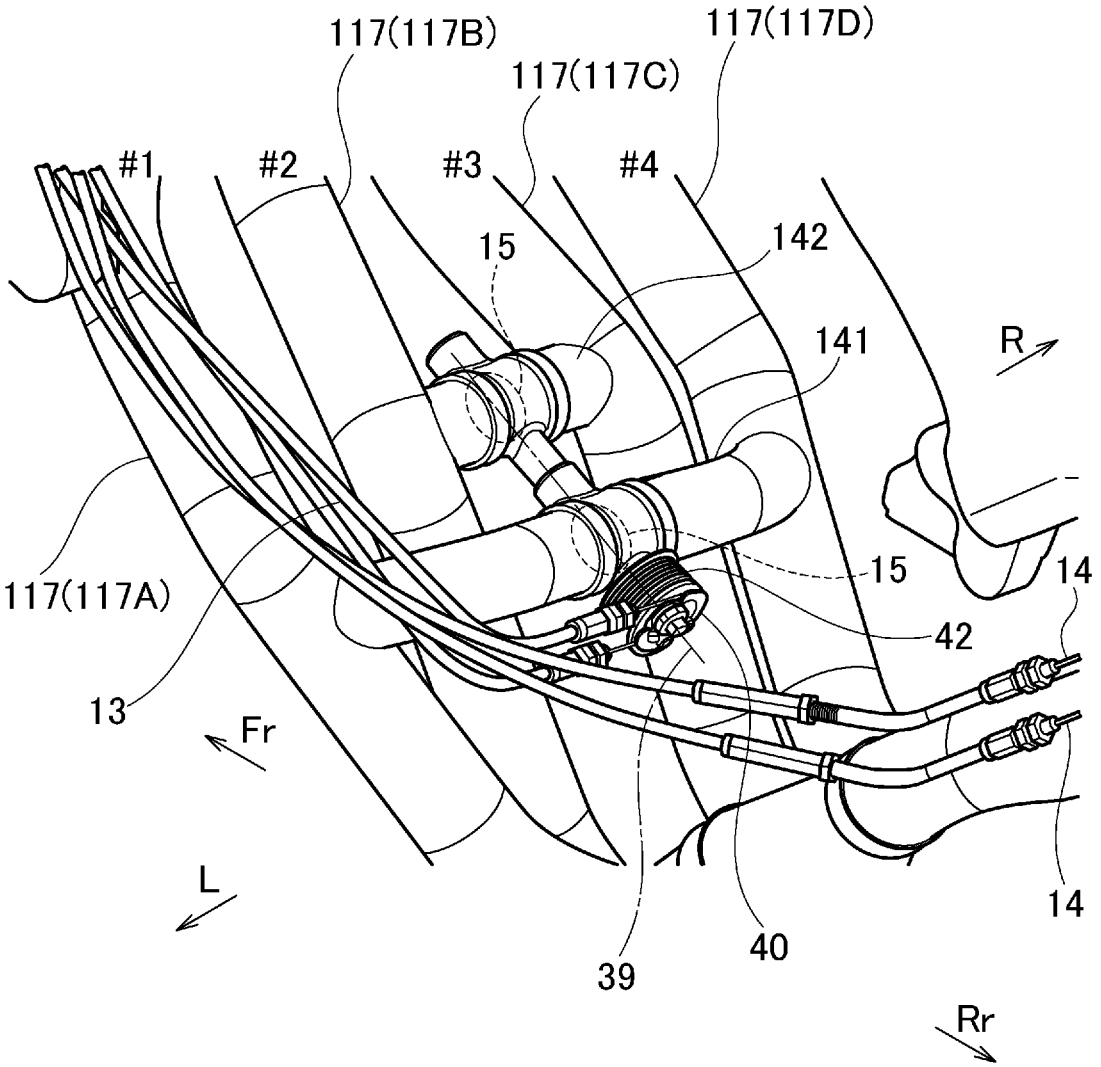
FIG. 10 is a perspective view illustrating an example of one of the objects controlled by the exhaust control device in the embodiment of the present invention.
Figure 11:
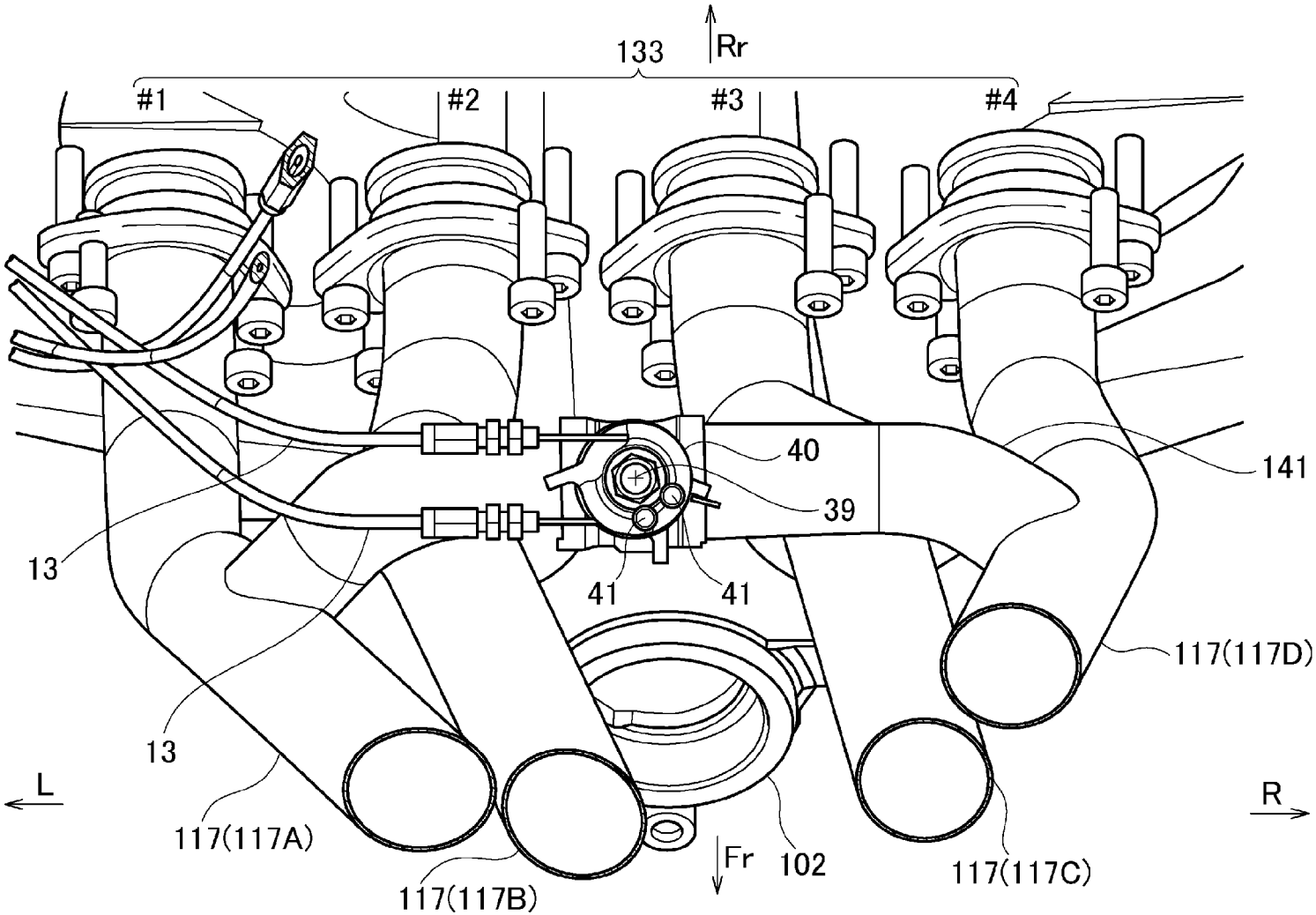
FIG. 11 is a perspective view illustrating an example of one of the objects controlled by the exhaust control device in the embodiment of the present invention.

As described above, the exhaust valves 15 are attached to the communication pipe 141 and the communication pipe 142, and the exhaust valve 16 is attached to the collecting pipe 139. The wires 13 connected to the actuator unit 11 are routed to a distribution part of the exhaust valve 15 as illustrated also in FIG. 9, and the wires 14 are routed to a distribution part of the exhaust valve 16. First, describing the exhaust valve 15 side, a coupling pipe 38 is provided between the communication pipe 141 and the communication pipe 142 as illustrated in FIG. 10, and a rotation shaft 39 is rotatably supported in the coupling pipe 38. The exhaust valves 15 attached to the communication pipe 141 and the communication pipe 142 respectively are mounted on the rotation shaft 39. In other words, the two exhaust valves 15 are coaxially arranged and supported by the single rotation shaft 39 and operate at synchronous timing. Though the detailed illustration of the rotation shaft 39 is omitted, a driven pulley 40 is mounted on one end side thereof, that is, the communication pipe 141 side in this example, and the driven pulley 40 is rotationally controlled by the operation of the actuator unit 11. Note that other terminals 41 of the wires 13 are held in lock holes (not illustrated) of the driven pulley 40 as illustrated in FIG. 11. Further, a return spring 42 is incidental to the driven pulley 40 and its resilient force urges the rotation shaft 39 in a direction of closing the exhaust valves 15.

Figure 9:
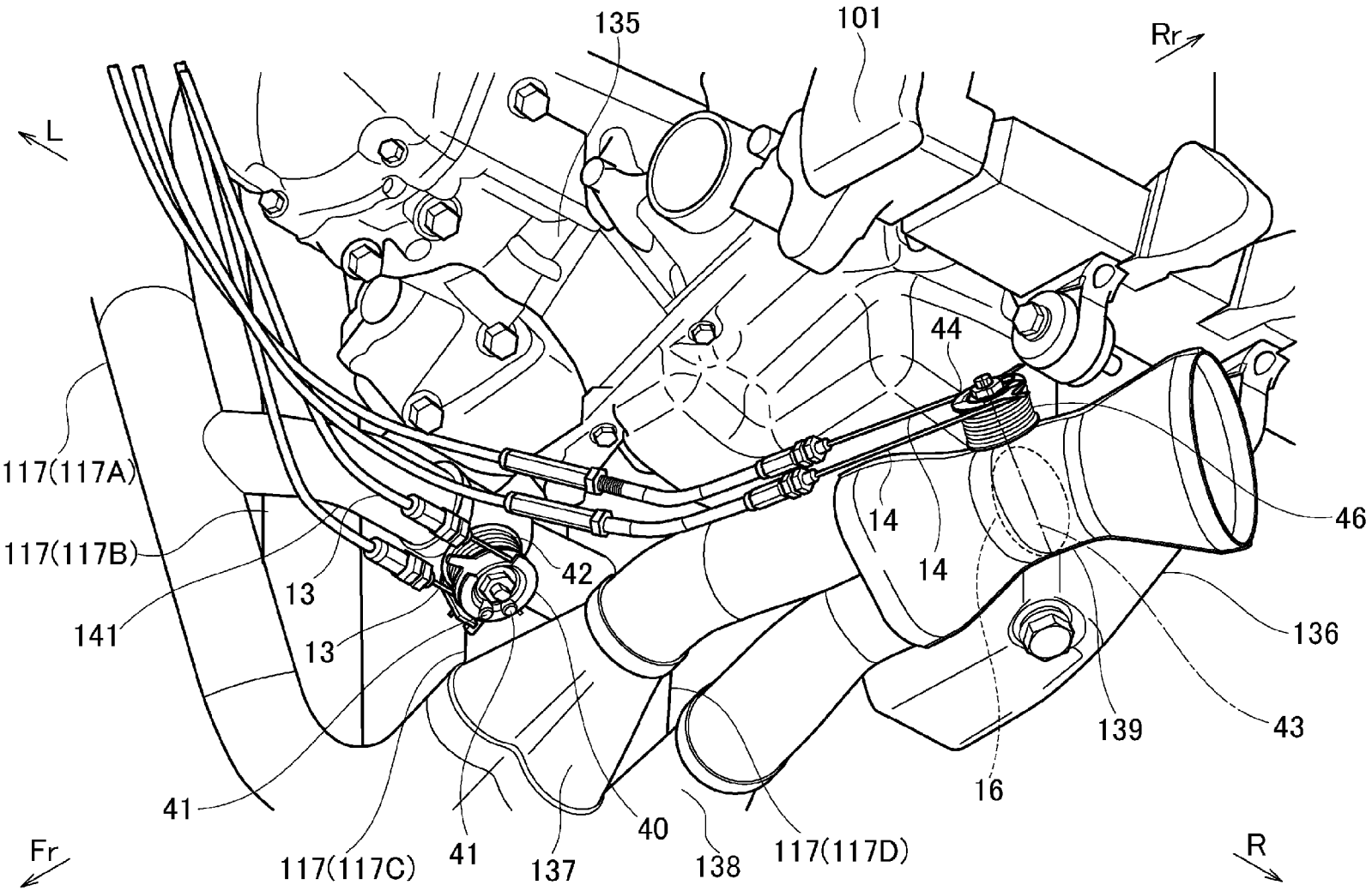
FIG. 9 is a perspective view illustrating an example of objects controlled by the exhaust control device in the embodiment of the present invention.
Figure 12:
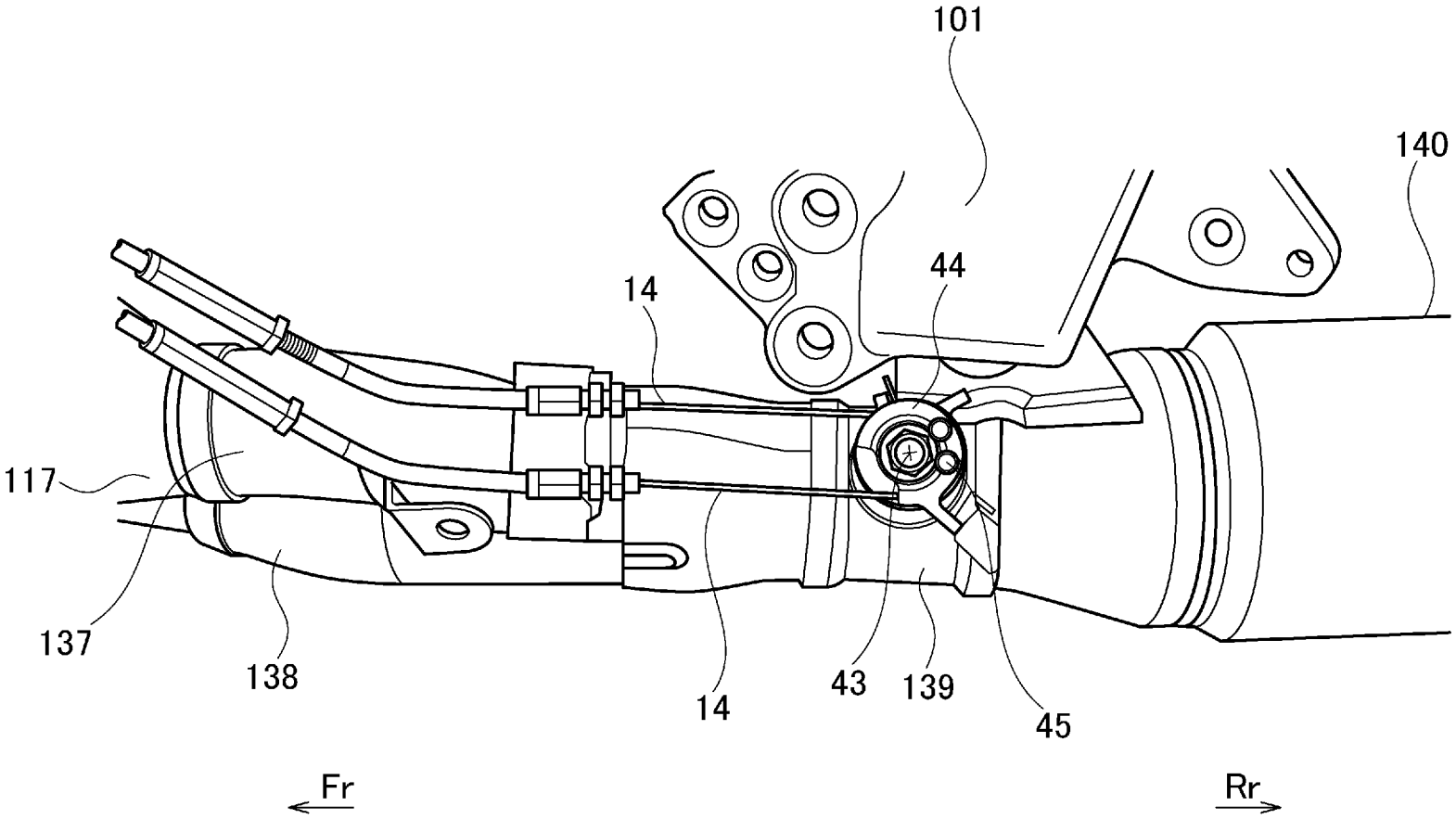
FIG. 12 is a perspective view illustrating an example of the other of the objects controlled by the exhaust control device in the embodiment of the present invention.

The exhaust valve 16 attached to the collecting pipe 139 is rotatably supported on a rotation shaft 43 as illustrated in FIG. 9. Though the detailed illustration of the rotation shaft 43 is omitted, a driven pulley 44 is mounted on one end side thereof (see also FIG. 12), and the driven pulley 44 is rotationally controlled by the operation of the actuator unit 11. Note that other terminals 45 of the wires 14 are held in lock holes (not illustrated) of the driven pulley 44 as illustrated in FIG. 12. Further, a return spring 46 is incidental to the driven pulley 44 and its resilient force urges the rotation shaft 43 in a direction of closing the exhaust valve 16.

In the above case, the actuator unit 11, in particular, the stepping motor 21 that is the drive source thereof is connected to an in-vehicle CPU (not illustrated). The stepping motor 21 is controlled by the CPU in relation to an engine rotation number and the like.

Figure 13A:
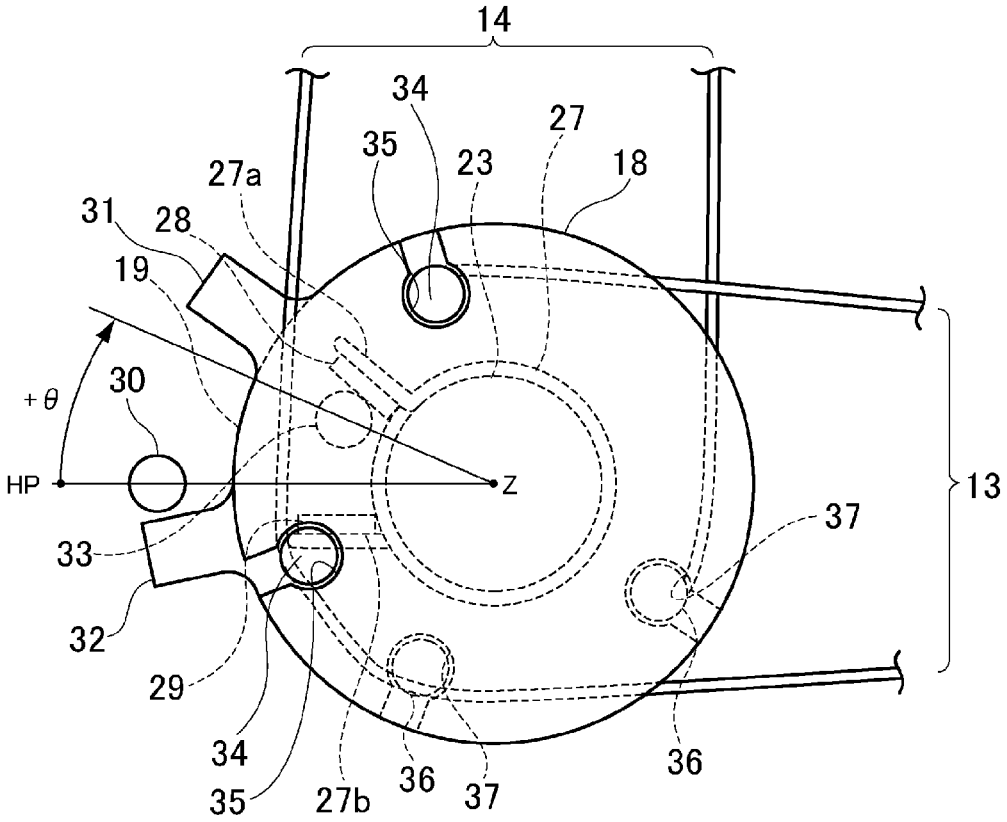
FIGS. 13A and 13B are a plan view illustrating an operation example of the actuator relating to one exhaust valve and a diagram illustrating a valve opening degree change in the embodiment of the present invention.

Next, a concrete example of exhaust control by the exhaust control device 10 of the present invention will be described. Here, the relation between the rotation angle of the actuator 20 and the opening degree of the exhaust valve 15 or the exhaust valve 16 will be described first. The actuator 20 rotates in a plus (+) or minus (−) direction from the home position HP. In the case of the exhaust valve 15, when the stepping motor 21 of the actuator unit 11 operates and the actuator 20 rotates in the plus direction as illustrated in FIG. 13A from the home position HP, the arm 33 comes into contact with the projection 28 of the first pulley 18 and rotates the first pulley 18 in the plus direction against the resilient force of the torsion spring 27, that is, the resilient force received from the one end 27*a* of the torsion spring 27. According to the rotation of the first pulley 18, the driven pulley 40 is rotated via the wires 13, and when the actuator 20 rotates in the plus direction by an angle θ, the two exhaust valves 15 of the communication pipe 141 and the communication pipe 142 are fully opened at the same time.

Figure 13B:
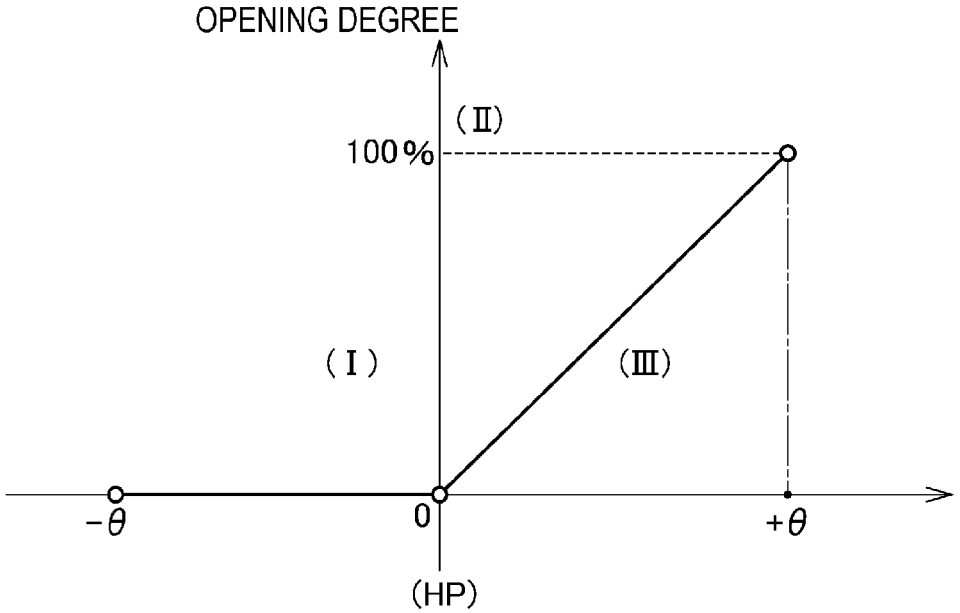

The exhaust valves 15 are in a fully closed state with an opening degree of 0% at the home position HP as illustrated in FIG. 13B, and when the angle θ is reached by rotation of the first pulley 18 in the plus direction as described above, the exhaust valves 15 are fully opened, namely, set to an opening degree of 100% at the same time. In a range in the minus direction from the home position HP of the actuator 20, the exhaust valves 15 are kept in the fully closed state with the opening degree of 0%.

Figure 14A:
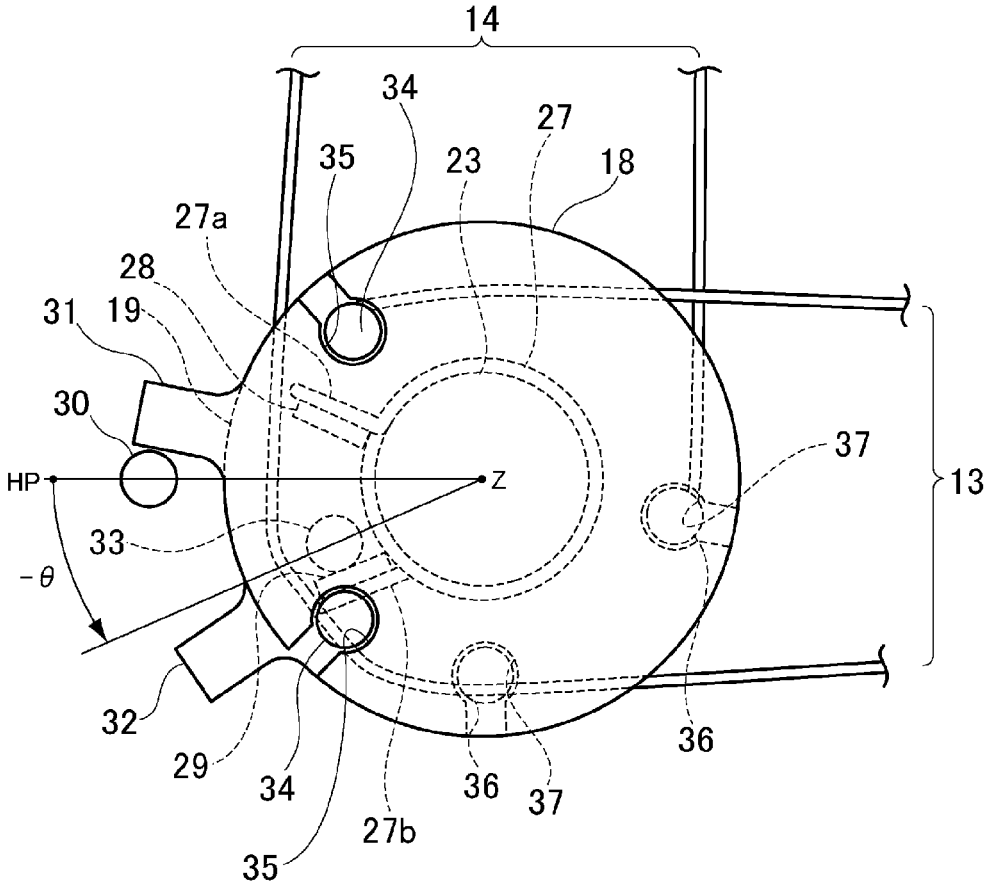
FIGS. 14A and 14B are a plan view illustrating an operation example of the actuator relating to the other exhaust valve and a diagram illustrating a valve opening degree change in the embodiment of the present invention.
Figure 14B:
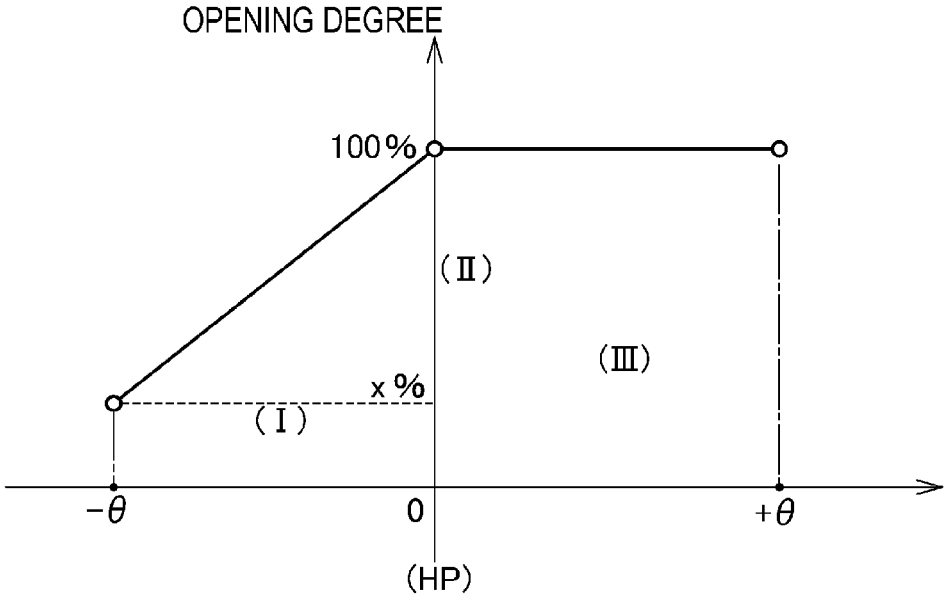

On the other hand, the minimum opening degree of the exhaust valve 16 of the collecting pipe 139 is set to a predetermined opening degree. The minimum opening degree is different depending on the engine specifications and the like and has a degree of freedom to some extent, but is set to an opening degree of X % as illustrated in FIG. 14B. In the relation to the rotation angle of the actuator 20, when the actuator 20 rotates in the minus direction from the home position HP by an angle of −θ as illustrated in FIG. 14A, the exhaust valve 16 is set to the opening degree of X %, and when the actuator 20 rotates in the plus direction from the angle of −θ, the exhaust valve 16 is fully opened, namely, set to an opening degree of 100% at the home position HP.

Figure 15A:
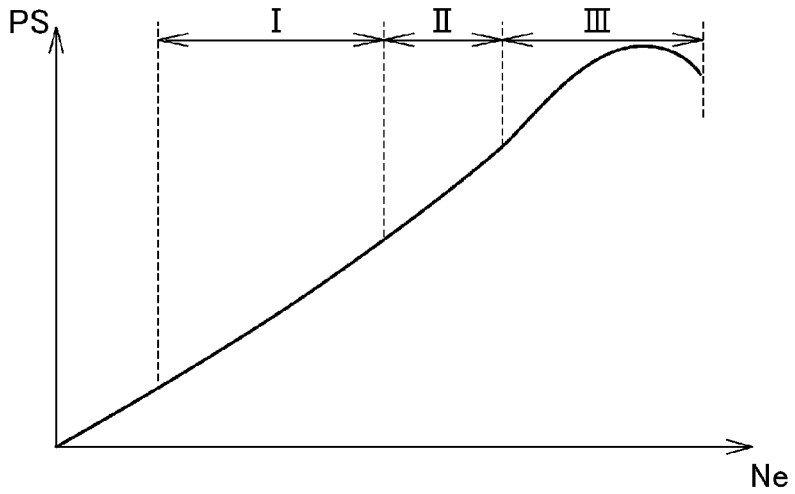
FIGS. 15A to 15C are diagrams illustrating the relation between an engine rotation number and an output characteristic and the relations between an engine rotation number and valve opening degrees in the embodiment of the present invention respectively.
Figure 15B:
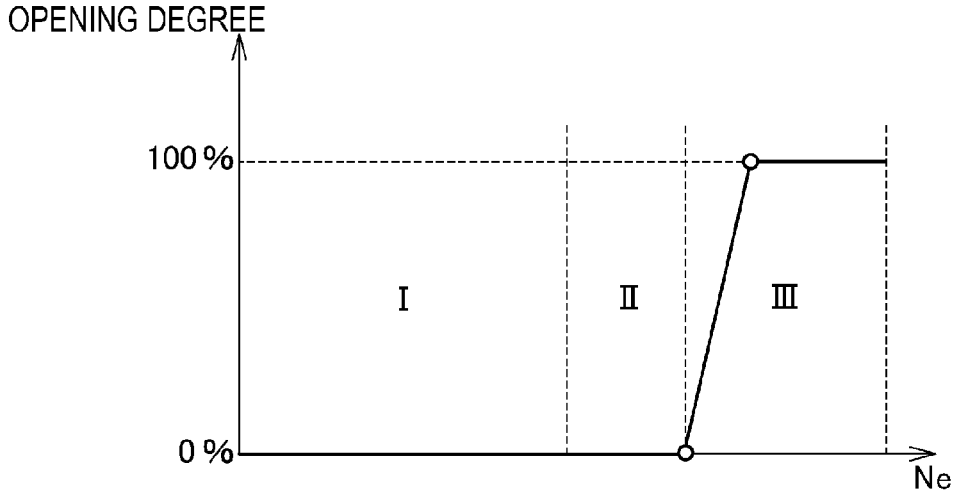
Figure 15C:
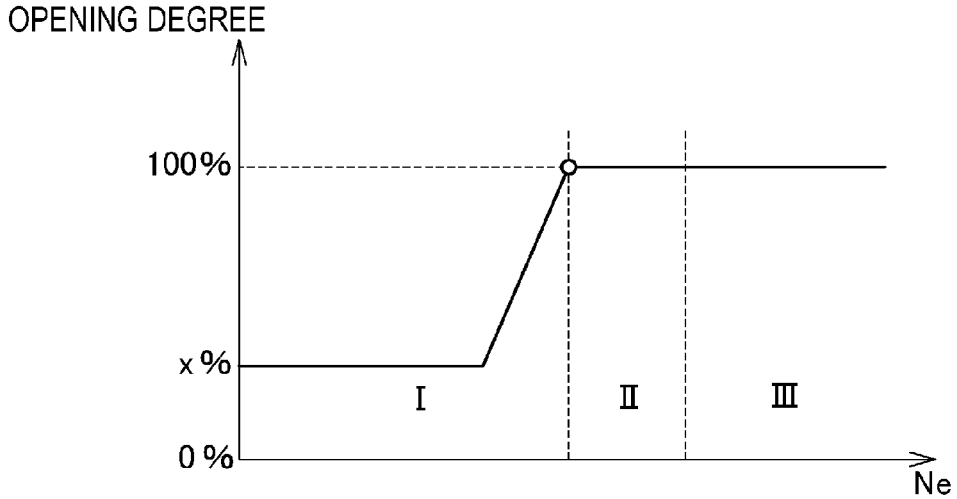

With respect to the rotation angle of the actuator 20, the two kinds of exhaust valve 15 and exhaust valve 16 can be controlled to open and close as described above. More concretely describing in the relation to the engine rotation number here, first, an engine output (PS) changes according to the engine rotation number (low speed range I, medium speed range II, and high speed range III) (Ne), for example, as in the example illustrated in FIG. 15A. In accordance with the engine output characteristics, the actuator 20 is driven to open and close the exhaust valves 15 and the exhaust valve 16. FIG. 15B illustrates the relation between the engine rotation number and the opening degree of the exhaust valves 15, and FIG. 15C illustrates the relation between the engine rotation number and the opening degree of the exhaust valve 16.

In the low speed range I of the engine rotation, the actuator 20 takes an operation start point in a range in the minus direction from the home position HP, and the exhaust valves 15 are first in the fully closed state as illustrated in FIG. 15B. On the other hand, the exhaust valve 16 initially has the opening degree of X %, so that the output can be effectively improved by keeping the exhaust valve 16 not fully opened. The actuator 20 rotates in the plus direction, whereby the exhaust valve 16 starts to open from the opening degree of X % and fully opens into the opening degree of 100% at the time when the second pulley 19 reaches the home position HP.

In the medium speed range II of the engine rotation, the actuator 20 further rotates in the plus direction, but the second pulley 19 is restricted in rotation because its small projection piece 32 comes into contact with the stopper 30, and the exhaust valve 16 is thus kept in the fully opened state at the home position HP. On the other hand, the exhaust valves 15 are kept in the fully closed state as illustrated in FIG. 15B. Generally, the engine is set in a normal rotation number range in the medium speed range II, so that the exhaust valves 15 are fully closed and the exhaust valve 16 is fully opened in the medium speed range II to effectively improve the output.

Further, in the high speed range III of the engine rotation, the actuator 20 rotates in the plus direction from the home position HP, but the second pulley 19 is kept at the home position HP by restriction of the rotation thereof. The first pulley 18 is urged by the arm 33 to rotate in the plus direction against the resilient force of the torsion spring 27. In other words, the exhaust valves 15 start to open from the fully closed state and become the fully opened state at a rotation angle of +θ as illustrated in FIG. 15B. The exhaust valve 16 is kept in the fully opened state also in the high speed range III as illustrated in FIG. 15C. Note that the engine rotation number shifting from the medium speed range II to the high speed range III is about 4000 rpm though depending on the type and so on of the motorcycle 100.

Contrary to the above, when the engine rotation shifts from the high speed range III to the medium speed range II and further to the low speed range I, the actuator 20 operates in the reverse procedure to that of the above-described operation. In short, the actuator 20 located on the side in the plus direction of the home position rotates in the minus direction.

Next, main operation and effect in the exhaust control device 10 of the present invention will be described. First, in the exhaust system from the exhaust pipes 117 to the muffler 118, the exhaust valves 15 attached to the communication pipe 141 and the communication pipe 142 and the exhaust valve 16 attached to the collecting pipe 139 are controlled to open and close by the actuator 20. The exhaust control device 10 is structured such that two controlled object parts are not independently controlled but the two kinds of exhaust valve 15 and exhaust valve 16 are controlled by the single actuator 20 as described above, thereby enabling reduction in the number of components in the device to simplify the device structure and reduction in cost.

In this case, the exhaust valves 15 attached to the communication pipe 141 and the communication pipe 142 are actually controlled to open and close in the high speed range III of the engine, so that the exhaust pulsation at the engine high rotation can be effectively utilized. Further, in that case, the exhaust valves 15 attached to the communication pipe 141 communicating the #1 and #4 cylinders and to the communication pipe 142 communicating the #2 and #3 cylinders respectively are coaxially arranged. This makes it possible to actually improve the output while effectively utilizing the exhaust pulsation at the engine high rotation.

Further, the exhaust valve 16 attached to the collecting pipe 139 is controlled to open and close from the low speed range I to the medium speed range II. This makes it possible to reduce exhaust resistance at the engine low rotation while effectively controlling the exhaust pulsation.

Further, with respect to the home position, the actuator 20 operates the exhaust valves 15 in one rotational operation range (on the side in the minus direction) and operates the exhaust valve 16 in the other rotational operation range (on the side in the plus direction). By allocating rotation angles of the actuator 20 to the exhaust valves 15 and the exhaust valve 16 which are the controlled objects, the single actuator 20 can appropriately and smoothly control the two kinds of controlled objects in an independent manner.

The rotation angle of the actuator 20 is controlled according to the engine rotation number as has already been described, whereby the exhaust valves 15 are closed and the exhaust valve 16 is opened to a predetermined opening degree at the engine low rotation. When the exhaust valves 15 are closed, the exhaust pulsation at the low rotation is made appropriate to improve the output at low speed. Further, at the engine high rotation, the exhaust valves 15 and the exhaust valve 16 are fully opened, thereby improving the reduction in exhaust pressure and making the exhaust pulsation comply with the high rotation range to improve the output.

Note that some modification examples and the like of the exhaust control device 10 of the present invention will be described here. For example, the actuator unit 11 is disposed on a side surface part of the main frame 101 as illustrated in FIG. 2 or FIG. 3 but may also be arranged such that the wire 13 and the wire 14 have substantially equal lengths as in FIG. 4 as another example. More specifically, the lengths of the wire 13 and the wire 14 can be made shortest by making distances A, B between the exhaust valve 15 and the exhaust valve 16 that are the connection destinations of the wire 13 and the wire 14 and the actuator unit 11 substantially equidistant as illustrated in FIG. 4. Then, the short lengths of the wire 13 and the wire 14 make the winding and reeling-out operations more smooth and reduce the device in weight.

Further, the reeling-out directions of the wires 13, 14 connected to the actuator unit 11 may be the same direction or different directions from each other. For example, the wires 13, 14 are reeled out from the actuator unit 11 in substantially the same direction in the exemplified example in FIG. 2. In addition to this case, in particular, the wire 14 connected to the exhaust valve 16 may be laid from the actuator unit 11 to the rear along the main frame 101 as illustrated in FIG. 4. The laying makes the wire 14 have an appropriate short length and is extremely advantageous in terms of layout.

As described above, the opening degree of the exhaust valves 15 or the exhaust valve 16 is controlled according to the engine rotation number. The opening and closing speed when opening and closing the exhaust valves 15 and the exhaust valve 16 corresponds to the angle of gradient of a graph in the exemplified example in FIGS. 15A to 15C and the like, but the speed-up and speed-down can also be appropriately adjusted by drive control of the stepping motor 21 by the actuator 20. The opening and closing timings of the exhaust valves 15 and the exhaust valve 16 can also be set as necessary. Further, the opening degrees may also be changed in a curved shape as a changed form, including the case where the opening degrees are linearly changed as in the exemplified example in FIGS. 15A to 15C and the like.

The present invention has been described together with various embodiments hereinabove, but the present invention is not limited only to the embodiments but may be modified within the scope of the present invention.

The exhaust control device of the present invention is applicable to a multicylinder engine with two cylinders or four cylinders or more.

Further, though the case of controlling two controlled objects such as the exhaust valve 15 and the exhaust valve 16 has been described in the above embodiments, it is also possible to set third and fourth controlled objects by adding third and fourth pulleys similarly configured as described above.

According to the present invention, the exhaust control device is structured such that exhaust valves which are controlled object parts to be controlled to open and close are not independently controlled but controlled by a single actuator, thereby enabling reduction in the number of components in the device to simplify the device structure and reduction in cost.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

What is claimed is:

1. An exhaust control device for an engine comprising:

an exhaust pipe of a first cylinder and an exhaust pipe of a second cylinder which converge at a first junction and an exhaust pipe of a third cylinder and an exhaust pipe of a fourth cylinder which converge at a second junction, the first junction and the second junction then converging at a single collecting pipe, which is connected to a muffler by a connection pipe;

a first communication pipe which connects the exhaust pipe of the first cylinder and the exhaust pipe of the fourth cylinder and a second communication pipe which connects the exhaust pipe of the second cylinder and the exhaust pipe of the third cylinder;

a first exhaust valve positioned in-line with the first communication pipe, a second exhaust valve positioned in-line with the second communication pipe, and a third exhaust valve positioned in-line with the collecting pipe, downstream from where the first junction and the second junction converge;

an actuator unit driving the first, second, and third exhaust valves to open and close;

wherein the actuator unit comprises;

an actuator that rotates, a first pulley arranged coaxially with a rotation axis of the actuator, that rotates from predetermined first position in predetermined first rotation direction around the rotation axis, that is urged in second rotation direction that is opposite to the first rotation direction, that closes the first exhaust value and the second exhaust valve when the first pulley is at the first position, and that increases an opening degree of the first exhaust valve and the second exhaust valve as rotating from the first position in the first rotation direction;

a second pulley arranged coaxially with the rotation axis of the actuator, rotates from predetermined second position in the second rotation direction, that is urged in the first rotation direction, that opens the third exhaust valve when the second pulley is at the second position, and decreases an opening degree of the third exhaust valve as rotating from the second position in the second rotation direction; and an arm rotating along with the rotation of the actuator, that does not move both the first pulley and the second pulley and has the first pulley at the first position and has the second pulley at the second position when the actuator is at the predetermined third position, that rotates only the first pulley in the first rotation direction as the actuator rotates from the third position in the first rotation direction, and that rotates only the second pulley in the second rotation direction as the actuator rotates from the third position in the second rotation direction.

2. The exhaust control device for an engine according to claim 1 further comprising:

a CPU controlling the actuator unit in relation to an engine rotation number;

wherein at low engine rpm the CPU controls the actuator so that the actuator rotates from the third position in the second rotation direction, wherein at medium engine rpm the CPU controls the actuator so that the actuator is at the third position, and wherein at high engine rpm the CPU controls the actuator so that the actuator rotates from the third position in the first rotation direction.

3. The exhaust control device for an engine according to claim 2, wherein the CPU controls the actuator so that at high engine rpm in relation to the engine rotation number the actuator rotates from the third position in the first rotation direction until the first exhaust valve and the second exhaust valve are fully open.

* * * * *